US005199331A

United States Patent [19]

Tsukamoto

[11] Patent Number: 5,199,331

[45] Date of Patent: Apr. 6, 1993

[54] DRAIN PLUG REMOVER

[76] Inventor: Kazuichi Tsukamoto, 63-38, Kitashinden, Ogawa Shimomashiki, Kumamoto, Japan

[21] Appl. No.: 917,413

[22] Filed: Jul. 23, 1992

[30] Foreign Application Priority Data

Sep. 20, 1991 [JP] Japan ..... 3-84847

[51] Int. Cl.[5] ..... B25B 13/00

[52] U.S. Cl. ..... 81/121.1; 81/125; 81/125.1; 81/124.2

[58] Field of Search ..... 184/1.5; 7/100; 81/121.1, 124.2, 3.07, 3.08, 3.09, 125, 125.1, 90.3, 91.3, 64; 141/98, 331, 330

[56] References Cited

U.S. PATENT DOCUMENTS

| | | | |
|---|---|---|---|
| 1,618,046 | 2/1927 | Barb | 81/125.1 |
| 1,668,245 | 5/1928 | McGowan . | |
| 1,686,749 | 10/1928 | Higgins et al. . | |
| 2,746,330 | 5/1956 | Pfetzing | 81/53 |
| 3,207,010 | 9/1965 | Wendling | 81/125 |
| 3,837,244 | 9/1974 | Schera, Jr. | 81/64 |
| 3,967,697 | 7/1976 | Guenther | 184/1.5 |
| 4,230,002 | 10/1980 | Skidmore | 81/121 R |
| 4,592,448 | 6/1986 | Morris | 184/1.5 |
| 4,714,138 | 12/1987 | Zaccone | 184/1.5 |
| 4,794,827 | 1/1989 | Poling | 81/125 |
| 4,867,017 | 9/1989 | Holman | 81/121.1 |
| 4,951,721 | 8/1990 | Moore et al. | 81/3.09 X |

*Primary Examiner*—D. S. Meislin
*Attorney, Agent, or Firm*—John F. Ingman

[57] ABSTRACT

A drain plug remover for vehicle engine oil pans includes a drain plug holding socket, a shield member and a handle. The socket, made of a resilient material, is formed having an open end which is slightly smaller than the head of the drain plug and includes longitudinal slits in its side wall, wherein, when the socket is pressed upon the drain plug, the socket expands to grasp the plug. An alternative means of holding the drain plug is by use of a magnet located within the socket. A shield member extends outwardly from the base of the socket, preferably in the form of a plate having an outer lip which curves towards the open end of the socket, thereby forming a concave, saucer-like receptacle to initially catch and subsequently deflect the flow of dirty oil away from the hand of the user. Extending from the shield member, opposing the socket, is a handle which the user grasps during removal and replacement of the drain plug. The handle includes longitudinal ridges to aid grasping and rotation of the tool. Alternatively, the drain plug remover may be formed with a second socket, in lieu of the handle, which allows removal of two different sizes of drain plugs with a single tool. The shield member preferably is formed with a concave receptacle for each socket, each concave receptacle having a lip extending toward the open end of its socket. The unused socket serves as the handle in this configuration.

5 Claims, 2 Drawing Sheets

DRAIN PLUG REMOVER

BACKGROUND OF THE INVENTION

1. Field of the Invention

This invention involves a drain plug remover, and more particularly, a drain plug remover which has a shield to deflect hot, dirty oil away from the hand of the user.

2. Description of the Prior Art

Generally, the removal of the drain plug from a vehicle oil pan includes the loosening of the plug with a wrench and then unscrewing and removing the drain plug by hand. This causes a problem in that the first flow of oil inevitably escapes before the plug is fully removed, thus causing hot, dirty oil to spill on the oil changer's hand.

What is needed is a simple, small, lightweight, easily cleanable, drain plug remover which allows a person, after loosening the drain plug of an oil pan, to deflect the first flow of oil away from his hand and into an oil receiving receptacle.

SUMMARY OF THE INVENTION

The present invention provides an oil drain plug remover designed to meet the aforementioned need. The drain plug remover includes a drain plug socket, a shield member formed to protect the hand from oil emanating from the drain plug hole, and a handle which the user grasps in rotatingly removing the drain plug.

Accordingly, in the preferred embodiment, the drain plug remover includes a socket which securely holds the drain plug. A socket, made of a resilient material, may be formed having an open end which is slightly smaller than the drain plug and includes longitudinal slits in its side wall, wherein, when the socket is pressed upon the drain plug, the socket expands to grasp the plug. An alternative means of holding the drain plug is by use of a magnet located within the socket. The drain plug normally would remain held by the socket until reinserted into the oil pan, The shield member extends outwardly from the base of the socket, preferably in the form of a plate having an outer lip which curves towards the open end of the socket, thereby forming a concave, saucer-like receptacle to initially catch and subsequently deflect the flow of dirty oil away from the hand of the user.

Extending from the shield member, opposing the socket, is a handle which the user grasps during removal and replacement of the drain plug. In the preferred embodiment, the handle is in the shape of a cylindrical knob having longitudinal ridges formed thereon to aid grasping and rotation of the tool.

Alternatively, due to the various sizes of drain plugs in use, the drain plug remover may be formed with a second socket, in lieu of the handle, which allows removal of two different sizes of drain plugs with a single tool. The shield member preferably is formed with a concave receptacle for each socket, each concave receptacle having a lip extending toward the open end of its socket. The unused socket serves as the handle in this configuration.

DESCRIPTION OF THE PREFERRED EMBODIMENT

Figure 1:
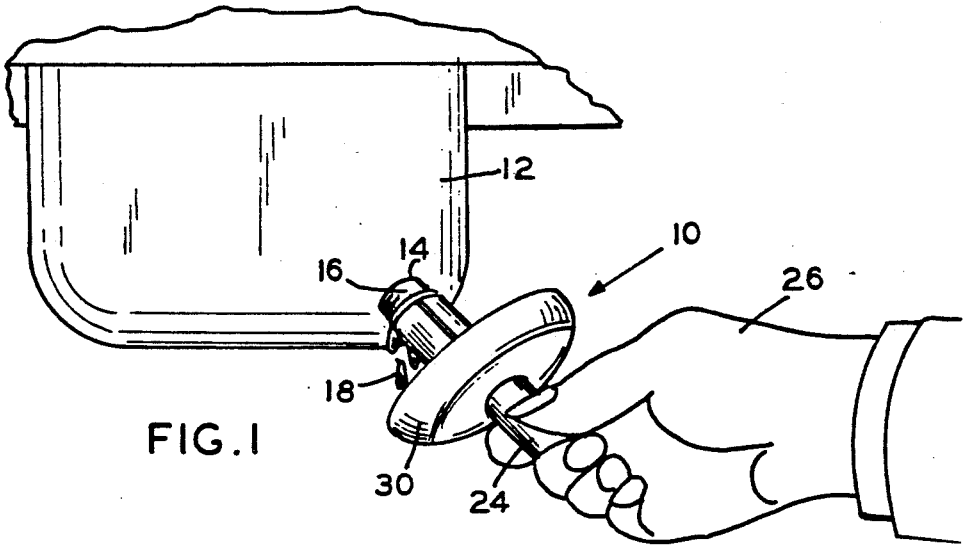
FIG. 1 illustrates the drain plug remover in use.
Figure 2:
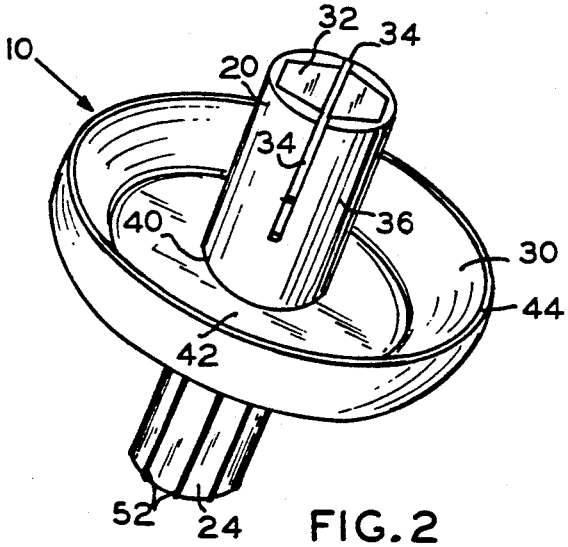
FIG. 2 illustrates a perspective view of a preferred embodiment of the drain plug remover. Z
Figure 3:
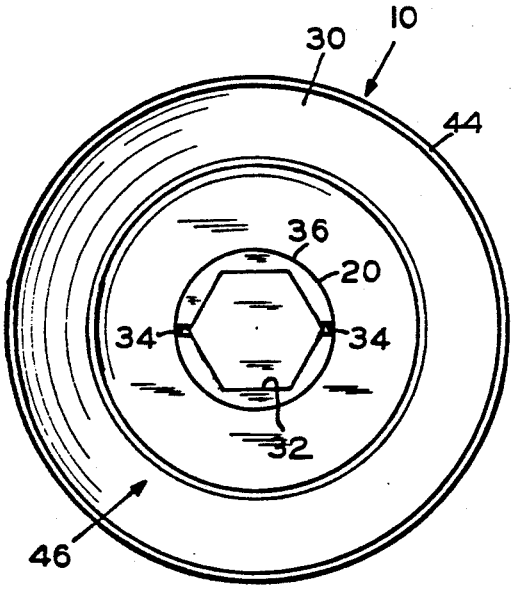
FIG. 3 illustrates a top view of the drain plug remover of FIG. 1 showing the socket.
Figure 4:
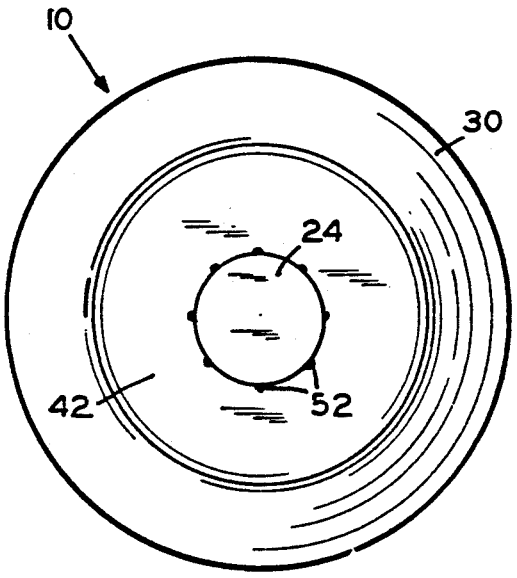
FIG. 4 illustrates a bottom view of the drain plug remover of FIG. 1 showing the handle.
Figure 5:
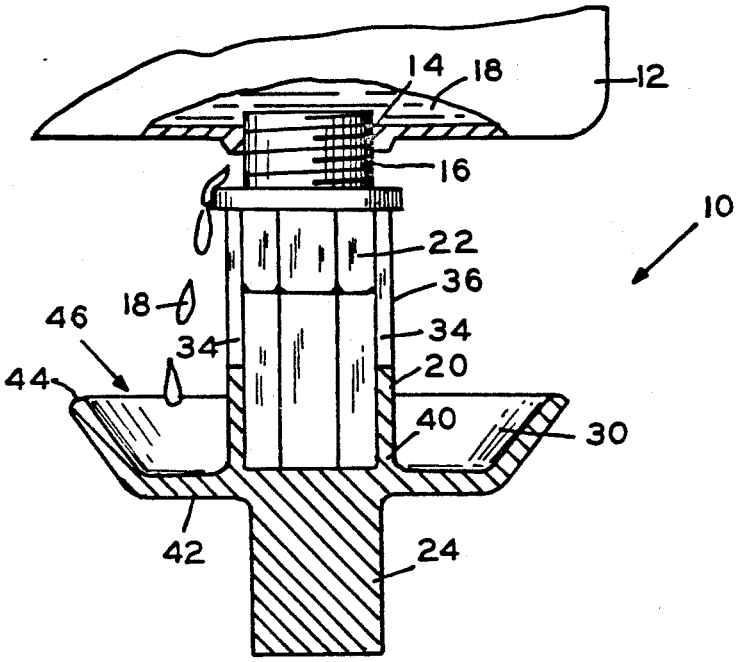
FIG. 5 illustrates a cross-sectional side view of the drain plug remover of FIG. 1 holding a drain plug.

Turning now to the drawings, there is shown in FIG. 1 a preferred embodiment of the drain plug remover 10 in use. Vehicles having an engine oil pan 12 commonly have formed therein a drain hole 14 from which a threaded drain plug 16 may be removed to permit the changing of its engine oil 18. In using the present drain plug remover CO, the drain plug 16 initially is loosened by a conventional wrench (not shown). After loosening, the drain plug remover 10 is attached by means of a socket 20 to the head 22 of the drain plug 16 and rotated at the handle 24 so as to unscrew the drain plug 16 from the oil pan 12. As the user continues to unscrew the drain plug 16, an initial flow of oil 18 escapes from the oil pan 12 and is deflected away from the user's hand 26 and down into a conventional used-oil receptacle (not shown) by a shield member 30 on the drain plug remover 10. The drain plug 16 is held by the drain plug remover 10, so that upon completion of drainage, the drain plug remover 10 may be used to reinsert the drain plug 16 into the drain hole 14 by rotation of the handle 24.

FIGS. 2 through 5 illustrate a preferred embodiment of the drain plug remover 10. The drain plug remover 10 includes a socket 20 which is formed to securely engage the head 22 of the drain plug 16. Secure engagement is desired so that the drain plug 16 may be both removed and replaced without having to physically handle the drain plug 16 itself; the drain plug 16 being securely held in the socket 20 until it is reinserted back into the drain hole 14 of the oil pan 12. Preferably, the socket 20 is formed of a hard, durable, resilient material such as plastic, wherein its open end 32 is formed to be slightly smaller than the head 22 of the drain plug 16. Longitudinal slits 34 are formed in the side wall 36 of the socket 20 at its open end 32 so as to permit slight resilient expansion when pressed upon the head 22 of the drain plug 16. The socket 20 thus expands in use to securely grasp the drain plug 16.

Figure 6:
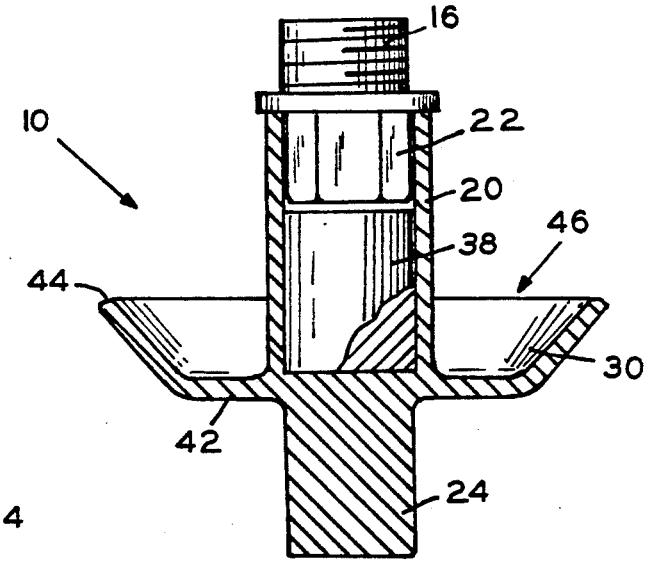
FIG. 6 illustrates a cross-sectional side view of a drain plug remover utilizing a magnet for drain plug retention.

An alternative means of holding a ferrous metal drain plug 16 is by use of a permanent magnet 38 located within the socket 20 adjacent to the position of the head 22 of the drain plug 16, as seen in FIG. 6.

The shield member 30 extends circumferentially outward from the socket 20 so as to interpose between the drain plug 16 and the user's hand 26, therefore shielding the user's hand 26 from the initial surge of dirty oil 18 as the drain plug 16 is loosened. The preferred form of a shield member 30 is a plate 42 initially extending radially from the base 40 of the socket 20 and then curving towards the open end 32 of the socket 20 with an outer lip 44. This provides a concave, saucer-like receptacle 46 which initially catches and subsequently deflects the flow of dirty oil 18 away from the hand 26 of the user.

Extending from the shield member 30, opposing the socket 20, is a handle 24 which the user grasps to rotate the drain plug remover 10. This handle 24 is in the shape of a cylindrical knob having longitudinal ridges 52 formed thereon to aid in grasping the handle 24, particularly during rotation.

Figure 7:
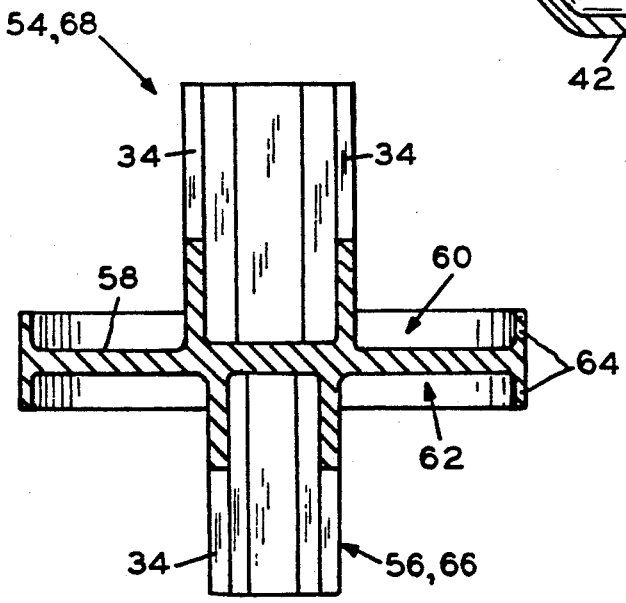
FIG. 7 illustrates a cross-sectional side view of an alternative configuration of the drain plug remover wherein an opposing socket of a different size is utilized in lieu of a handle.

Various sizes of drain plugs 16 are utilized in different vehicles. For individual use, a single drain plug remover 10, having a properly sized socket 20, may be adequate. In professional use, however, it may be desirable to have a drain plug remover 10 which is formed with two sockets 54 and 56, which allows removal of two different sizes of drain plug 16 with a single tool. This alternative configuration is seen at FIG. 7, where socket 54 and second socket 56 are positioned on opposing sides of shield member 58. As illustrated, socket 54 and second socket 56 are of the type utilizing slits 34, as described above, for retention of the drain plug 16. Shield member 58 preferably is formed with two concave, saucer-like receptacles 60, 62 for sockets 54 and 56 respectively. Each receptacle 60, 62 includes a lip 64 extending towards its respective socket 54, 56. When socket 54 is being used, second socket 56 serves as a handle 66, Similarly, when socket 56 is being used, socket 54 becomes the handle 68.

It is thought that the drain plug remover of the present invention and its many attendant advantages will be understood from the foregoing description and that it will be apparent that various changes in form, construction and arrangement of the parts thereof may be made without departing from the spirit and scope of the invention or sacrificing all of its material advantages, the form hereinbefore described being merely an exemplary embodiment thereof.

I claim:

1. A tool for removing a drain plug from a vehicle engine oil pan, comprising:

a. a socket formed to engage the drain plug;

b. a shield member extending circumferentially outward from said socket so as to interpose between the drain plug and a user's hand; and c. a handle, extending from the shield member and opposing said socket, which the user's hand grasps to hold and rotate the tool;

d. said handle being formed to a second socket of different size than said socket;

e. said shield member being formed with two, opposing, concave receptacles, providing a concave receptacle for each socket.

2. A tool for removing a drain plug, as recited in claim 1, wherein said socket includes means for securely holding the drain plug within said socket.

3. A tool for removing a drain plug, as recited in claim 2, said socket including an open end and being formed of a resilient material, wherein said means for securely holding the drain plug within said socket include having said open end formed slightly smaller than the drain plug and having at least one longitudinal slit formed at said open end of said socket to permit resilient expansion of said socket when pressed upon said drain plug.

4. A tool for removing a drain plug, as recited in claim 2, wherein said means for securely holding the drain plug within said socket include a magnet.

5. A tool for removing a drain plug, as recited in claim 1, wherein said handle is formed with a plurality of longitudinal ridges.

* * * * *